US006113741A

United States Patent [19]

Kettunen et al.

[11] Patent Number: 6,113,741

[45] Date of Patent: Sep. 5, 2000

[54] PROCESS FOR THE PRODUCTION OF PAPER

[75] Inventors: Kalle Kettunen, Esbo, Finland; Åke Kjellander, Pixbo; Maria Norell, Hovås, both of Sweden

[73] Assignee: Eka Chemicals AB, Bohus, Sweden

[21] Appl. No.: 08/984,831

[22] Filed: Dec. 4, 1997

[30] Foreign Application Priority Data

Dec. 6, 1996 [SE] Sweden ..... 9604516
Dec. 6, 1996 [SE] Sweden ..... 9604579

[51] Int. Cl.[7] ..... D21H 21/10

[52] U.S. Cl. ..... 162/158; 162/168.1; 162/168.2; 162/168.3; 162/175; 162/181.2; 162/181.6; 162/181.8; 162/183; 162/190

[58] Field of Search ..... 162/183, 185, 162/190, 336, 158, 168.1, 175, 168.2, 168.3, 181.6, 181.2

[56] References Cited

U.S. PATENT DOCUMENTS

| | | | |
|---|---|---|---|
| 4,042,453 | 8/1977 | Conway et al. | 162/108 |
| 4,388,150 | 6/1983 | Sunden et al. | 162/175 |
| 4,643,801 | 2/1987 | Johnson | 162/164.1 |
| 4,795,531 | 1/1989 | Sofia et al. | 162/164.6 |
| 4,909,904 | 3/1990 | Kinzler | 162/343 |
| 4,927,498 | 5/1990 | Rushmere | 162/168.3 |
| 5,180,624 | 1/1993 | Kojima et al. | 428/211 |
| 5,196,091 | 3/1993 | Hergert | 162/258 |
| 5,316,383 | 5/1994 | Begemann et al. | 366/160 |
| 5,368,833 | 11/1994 | Johansson et al. | 423/338 |
| 5,401,363 | 3/1995 | Begemann et al. | 162/164.6 |
| 5,545,293 | 8/1996 | Huovila et al. | 162/212 |
| 5,549,793 | 8/1996 | Hellstrom et al. | 162/258 |
| 5,560,807 | 10/1996 | Hauser | 162/183 |
| 5,571,494 | 11/1996 | Saastamoinen | 423/338 |
| 5,746,889 | 5/1998 | Huovila et al. | 162/216 |
| 5,759,346 | 6/1998 | Vinson | 162/123 |
| 5,827,398 | 11/1998 | Depasquale et al. | 162/164.1 |

FOREIGN PATENT DOCUMENTS

| | | | |
|---|---|---|---|
| 0 235 893 | 9/1987 | European Pat. Off. | D21D 3/00 |
| 0 335 575 | 10/1989 | European Pat. Off. | D21D 3/00 |
| 0 733 735 | 9/1996 | European Pat. Off. | D21F 1/08 |
| WO 96/35838 | 11/1996 | WIPO | D21F 1/66 |

OTHER PUBLICATIONS

*Abstract*, EP 733, 735, Sep. 25, 1996.
*International Search Report*, dated Mar. 11, 1998.

*Primary Examiner*—Peter Chin
*Attorney, Agent, or Firm*—Ralph J. Mancini; Lainie E. Parker

[57] ABSTRACT

The invention relates to a process for the production of paper on a paper machine containing a dilution headbox in which a main aqueous flow containing cellulosic fibres and filler is mixed in said headbox with a diluting aqueous flow to form a resulting aqueous flow which is ejected onto a wire and dewatered to form a web of paper, wherein one or more components providing improved retention are introduced into the main aqueous flow and an additive resulting in slower dewatering and/or being selected from non-ionic and anionic organic polymers is introduced into the diluting aqueous flow.

24 Claims, No Drawings

PROCESS FOR THE PRODUCTION OF PAPER

FIELD OF THE INVENTION

The present invention relates to a process for the production of paper on a paper machine containing a dilution headbox and more particularly to a process in which additives affecting retention and dewatering are introduced into a stock before it is being ejected from the headbox onto a wire and dewatered to form a web of paper.

BACKGROUND

In the papermaking art, an aqueous suspension containing cellulosic fibres, fillers and additives, referred to as a stock, is fed into a headbox which ejects the stock onto a forming wire through a slice opening. Water is drained from the stock through the forming wire so that a wet web of paper is formed on the wire, and the web is further dewatered and dried in the drying section of the paper machine. Retention agents are usually introduced into the stock in order to increase adsorption of fine particles, e.g. fine fibres and fillers, onto the cellulosic fibres so that they are retained with the fibres on the wire. A wide variety of retention agents are known in the art, examples of which include linear, branched and cress-linked organic polymers of anionic, non-ionic, amphoteric and cationic nature, organic polymers of different molecular weights, inorganic materials, and many combinations thereof. Due to incomplete retention, the water obtained by dewatering the stock and the wet web, referred to as white water or back water, contains fine particles not being retained on the wire and this water is usually recirculated in different flow circuits.

Due to non-uniform shrinkage of the paper web in the drying process, the resultant dried web usually has a non-uniform basis weight profile in a cross-machine direction. Notably, the shrinkage in the middle area of the paper web is lower than in the lateral areas, thereby producing a higher dry basis weight in both of the lateral areas of the web. In the past, a lip defining the slice opening has been controlled along its length to control the basis weight profile of the web. However, in practice, it is very difficult to obtain a uniform basis weight across the width of the web using this type of control arrangement. In addition, attempts to control the basis weight profile in this manner affect the fibre orientation profile of the paper web which, usually, results in adverse effects on the quality of the paper produced, such as anisotropy of strength and stretch.

Improved basis weight profile can be attained in a different type of headbox design, referred to as dilution headbox, in which the basis weight profile of the paper web is controlled by dilution of the stock fed into the headbox with water. Usually, the water used in the dilution process is white water, and hereby the flow of stock having a high consistency is diluted with a low consistency flow originating from the white water. For example, the headbox can have a series of mixing sections or dilution lines distributed over the width of the headbox. White water is injected into the mixing sections to locally control the stock dilution thereby forming a variable consistency profile leaving the slice opening at a constant volume flow. By adjusting the amount of dilution, i.e. the ratio of high consistency flow to low consistency flow, at a plurality of points of the headbox across the machine, for example in response to a measured basis weight profile from on-line scanners, the basis weight of the web can be controlled in an improved manner and rendered essentially uniform in a cross machine direction. A constant volume flow in a cross machine direction may also have beneficial effects on the fibre orientation profile.

However, in paper machines employing dilution headbox designs, notably when using high performance retention agents, it has been experienced that the paper web produced has varying formation and composition across the width of the web. Notably, it has been found that the paper web has a non-uniform ash content cross profile, thereby producing paper out of specification. In some cases the ash content has been much lower in the lateral areas than in the middle area of the web.

THE INVENTION

According to the present invention, when paper is produced on a paper machine containing a dilution headbox, it has been found that a web of paper having a more uniform ash content cross profile can be obtained by the introduction of a specific system of additives into a stock in a certain manner before it is dewatered on a wire to form the web of paper. It has further been found that the process of the invention can provide improved formation of the paper web produced. Therefore, in accordance with the present invention, there is provided a process for the production of paper on a paper machine comprising a dilution headbox in which a main aqueous flow containing cellulosic fibres and filler is mixed in said headbox with a diluting aqueous flow to form a resulting aqueous flow which is ejected onto a wire and dewatered to form a web of paper, wherein one or more components providing improved retention are introduced into the main aqueous flow and an additional additive is introduced into the diluting aqueous flow prior to dewatering, the additional additive resulting in slower dewatering and/or being selected from non-ionic and anionic organic polymers. The invention thus relates to a process as further defined in the claims.

Dilution headboxes generally can be described as devices comprising at least one inlet for a first partial volume flow, at least one inlet for a second partial volume flow, at least on section for mixing the partial volume flows to form a mixture volume flow, and at least one outlet for ejecting the mixture volume flow. Preferably the dilution headbox comprises a plurality of such inlets, sections and outlets across its working width. Examples of suitable dilution headboxes include those disclosed in U.S. Pat. Nos. 4,909,904; 5,196,091; 5,316,383; 5,545,293; and 5,549,793.

The term "main aqueous flow", as used herein, refers to the main flow of stock containing cellulosic fibres and filler entering the headbox which has a high consistency (hereafter HC), i.e. a high solids content, thereby representing the high consistency flow (hereafter HC flow). The consistency of the HC flow can be within the range of from 0.1% to 3.5% by weight, suitably from 0.3% to 2.2% and preferably from 0.4% to 1.9%. The term "diluting aqueous flow", as used herein, refers to the aqueous flow which is used to dilute the HC flow and which, in relation to the HC flow, has a low consistency (LC), i.e. a low solids content, thereby representing the low consistency flow (hereafter LC flow). The consistency of the LC flow can he within the range of from 0–1.5% by weight, suitably 0.002–0.9%, and preferably 0.005–0.8% with the proviso that the consistency of the LC flow is lower than that of the HC flow. In the headbox, the HC flow is mixed and diluted with the LC flow, for example just before the turbulence generator, to form a resulting flow which is discharge onto the wire for dewatering. The volume ratio of HC flow to LC flow can be within the range of from 99:1 to 50:50, suitably from 97:3 to 60:40, preferably from 95:5 to 75:25 and typically about 85:15. As conventional in dilution headbox designs, the volume ratio of HC flow to LC flow preferably is varying at a plurality of points of the headbox across its width in order to adjust the amount of dilution, thereby enabling control of the basis weight cross profile of the paper web formed. Preferably the partial volume flows, i.e. the HC flow and the LC flow, are mixed in the headbox to form a resulting HC/LC mixture volume flow which is ejected from the headbox and which is essentially constant in a cross-machine direction.

The aqueous LC flow used for dilution can be selected from fresh water, white water and other types of aqueous flows that are recycled in the process. The diluting LC flow may contain fibre fines and filler, and it may be treated by means of any purification step before being fed into the headbox. Examples of suitable steps that can be used for purifying or clarifying aqueous flows of these types include filtration, flotation, sedimentation, anaerobic and aerobic treatment. Preferably, the LC flow is white water which can contain fines, filler and further additives introduced into the HC flow but not being retained on the wire. The white water used is preferably obtained by dewatering the stock and/or the wet web on the wire, and it may be clarified as mentioned above before being fed into the dilution headbox. In the present process, the LC flow should suitably have a composition different from that of the HC flow, and notably the filler content of the LC flow differs from that of the HC flow. Preferably the LC flow has a higher filler content, expressed as percentage of the dry substance of the flow, than the HC flow.

In addition to the HC flow and the LC flow entering the headbox as described above, there can be at least one additional flow entering the headbox in accordance with the present invention. The additional flow is preferably a flow that contains water alone. The additional flow may also be a flow of stock or pulp, the consistency and/or composition of which differs from that of the HC flow.

The component(s) providing improved retention according to this invention may be a single retention agent or a retention system, for example any of those defined hereinafter. The single component can be any component functioning as a retention agent, preferably a cationic polymer. In this embodiment, the amount of the component introduced into the main aqueous flow should be sufficient so as to give better retention that is obtained when not adding the component.

In a preferred embodiment of this invention, there is used a retention system. The term "retention system", as used herein, refers to at least two components which, when being added to a stock, give better retention than is obtained when not adding the components. The components of retention systems are preferably selected from organic polymers and organic polymers in combination with aluminum compounds and/or inorganic microparticles. In a particularly preferred embodiment of the invention, there is used a microparticle retention system. The term "microparticle retention system", as used herein, refers to a retention system comprising a microparticulate material, or microparticles, such as, for example, anionic inorganic particles, cationic inorganic particles and organic microparticles. The microparticulate material is used in combination with at least one further component, usually at least one organic polymer, herein also referred to as a main polymer, preferably a cationic, amphoteric or anionic polymer. Anionic microparticles are preferably used in combination with at least one amphoteric and/or cationic polymer, whereas cationic microparticles are preferably used in combination with at least one amphoteric and/or anionic polymer. Preferably the microparticles are anionic inorganic particles. It is further preferred that the microparticles are in the colloidal range of particle size. The retention system, e.g. systems comprising microparticles, can comprise more than two components; for example, it can be a three- or four-component retention system. Suitable additional components include one or more of aluminium compounds and low molecular weight cationic organic polymers. Usually retention systems, including microparticle retention systems, also give better dewatering than is obtained when not adding the components, and the systems are commonly referred to as retention and dewatering systems.

Anionic inorganic particles that can be used according to the invention include anionic silica-based particles and clays of the smectite type. Anionic silica-based particles, i.e. particles based on $SiO_2$ or silicic acid, including colloidal silica, different types of polysilicic acid, colloidal aluminium-modified silica or aluminium silicates, and mixtures thereof, are preferably used, either alone or in combination with other types of anionic inorganic particles. Anionic silica-based particles are usually supplied in the form of aqueous colloidal dispersions, so-called sols. Retention and dewatering systems comprising suitable anionic silica-based particles are disclosed in U.S. Pat. Nos. 4,388,150; 4,927,498; 4,954,220; 4,961,825; 4,980,025; 5,127,994; 5,176,891; 5,368,833; 5,447,604; 5,470,435; 5,543,014; 5,571,494; 5,584,966; and 5,603,805, which are all hereby incorporated herein by reference.

Anionic silica-based particles suitably have an average particle size below about 50 nm, preferably below 20 nm and more preferable in the range from about 1 to about 10 nm. As conventional in silica chemistry, the particle size refers to the average size of the primary particles, which may be aggregated or non-aggregated. The specific surface area of the silica-based particles is suitably above 50 $m^2/g$ and preferably above 100 $m^2/g$. Generally, the specific surface area can be up to about 1700 $m^2/g$ and preferably up to 1000 $m^2/g$. The specific surface area can be measured by means of titration with NaOH in known manner, e.g. as described by Sears in Analytical Chemistry 28(1956):12, 1981–1983 and in U.S. Pat. No. 5,176,891. The given area thus represents the average specific surface area of the particles.

In a preferred embodiment of the invention, the anionic inorganic particles are silica-based particles, e.g. colloidal silica or aluminium-modified silica, having a specific surface are within the range of from 50 to 1000 $m^2/g$ and preferably from 100 to 950 $m^2/g$. Preferably, the anionic inorganic particles are present in a silica sol having an S-value in the range of from 8 to 45%, preferably from 10 to 30%, containing silica particles with a specific surface area in the range of from 300 to 1000 $m^2/g$, suitably from 500 to 950 $m^2/g$, and preferably from 750 to 950 $m^2/g$, which particles can he non-aluminium-modified or aluminium-modified, suitably aluminium-modified and preferably the particles are surface-modified with aluminium to a degree of from 2 to 25% substitution of silicon atoms. The S-value can be measured and calculated as described by Iler & Dalton in J. Phys. Chem. 60(1956), 955–957. The S-value indicates the degree of aggregate or microgel formation and a lower S-value is indicative of a higher degree of aggregation.

In yet another preferred embodiment of the invention, the anionic inorganic particles are selected from polysilic acid and colloidal aluminium-modified silica or aluminium-silicate having a high specific surface area, suitably above about 1000 $m^2/g$. The specific surface area can be within the range of from 1000 to 1700 $m^2/g$ and preferably from 1050 to 1600 $m^2/g$. In the art, polysilicic acid is also referred to as polymeric silicic acid, polysilicic acid microgel, polysilicate and polysilicate microgel, which are all encompassed by the term polysilicic acid used herein. Aluminium-containing compounds of this type are commonly also referred to as polyaluminosilicate and polyaluminosilicate microgel, which are both encompassed by the terms colloidal aluminium-modified silica and aluminium silicate used herein.

Clays of the smectite type that can be used in the process of the invention are known in the art and include naturally occurring, synthetic and chemically treated materials. Examples of suitable smectite clays include montmorillonite/bentonite, hectorite, beidelite, nontronite and saponite, preferably bentonite and especially such which after swelling preferably has a surface area of from 400 to 800 $m^2/g$. Suitable clays are disclosed in U.S. Pat. Nos. 4,753,710; 5,071,512; and 5,607,552, which are hereby incorporated herein by reference, the latter patent disclosing mixtures of anionic silica-based particles and smectite clays, preferably natural bentonites. Cationic inorganic particles that can be used include cationic silica-based particles, cationic alumina, and cationic zirconia.

Suitable organic polymers for use in this invention can be anionic, non-ionic, amphoteric, or cationic in nature, they can be derived from natural or synthetic sources and they can be linear, branched or cross-linked, e.g. in the form of microparticles. Preferably the polymer is water-soluable or water-dispersable. Examples of suitable main polymers include anionic, amphoteric and cationic starches, anionic, amphoteric and cationic guar gums, and anionic, amphoteric and cationic acrylamide-based polymers, as well as chitosans, poly(diallylidimethyl ammonium chloride), polyethylene imines, polyamines, polyamidoamines, milamine-formaldehyde and urea-formaldhyde resins. Cationic starches and cationic acrylamide-based polymers are particularly preferred polymers according to the invention, both as single retention components as well as in retention systems with and without anionic inorganic particles. The molecular weight of the main polymer is usually above 200,000, suitably above 300,000, preferably at least 500,000 and most preferably at least 1,000,000. Usually the molecular weight is below about 20,000,000.

Further suitable polymers for use in this invention include low molecular weight (hereinafter LMW) cationic organic polymers, also referred to as anionic trash catchers (ATC's). ATC's are known in the art as neutralizing agents for detrimental anionic substances present in the stock and the use thereof in combination with retention components or systems often provide improved retention. Accordingly, ATC's are preferably comprised as a component in retention systems which are used with stocks having a high cationic demand. Suitable ATC's include LMW highly charged cationic organic polymers such as polyamines, polyethleneimines, homo- and copolymers based on diallyldimethyl ammonium chloride, (meth)acrylamides and (meth)acrylates. In relation to the molecular weight of the main polymer, the molecular weight of the LMW cationic organic polymer is preferably lower; it is suitably at least 2,000 and preferably at least 10,000. The upper limit of the molecular weight is usually about 700,000, and suitably about 500,000. Suitable retention systems comprising ATC's include those comprising a main polymer of amphoteric or cationic nature. LMW cationic polymers may also be used as site blocking agents (SBA) to improve conformation of adsorbed high molecular weight polymers in order to give more efficient flocculation.

Aluminium compounds that can be used according to the invention include alum, aluminates, aluminium chloride, aluminium nitrate and polyaluminium compounds, such as polyaluminium chlorides, polyaluminium sulphates, polyaluminium compounds containing both chloride and sulphate ions, polyaluminium silicate-sulphates, and mixtures thereof. The polyaluminium compounds may also contain other anions, for example anions from phosphoric acid, sulphuric acid, organic acids such as citric acid and oxalic acid.

Suitable microparticle retention systems according to the invention comprises anionic silica-based particles in combination with cationic starch, cationic guar gum or cationic acrylamide-based polymer (preferably anionic colloidal silica or polysilicic acid in combination with cationic starch, and anionic colloidal aluminium-modified silica or aluminium silicate in combination with cationic acrylamide-based polymer and optionally also with an ATC anionic silica-based particles in combination with anionic acrylamide-based polymer and cationic polymer selected from cationic starch, cationic guar gum or cationic acrylamide-based polymer, bentonite in combination with cationic acrylamide-based polymer and optionally also with an ATC; cationic silica-based particles in combination with anionic starch, anionic guar gum or anionic acrylamide-based polymer, anionic silica-based particles in combination with anionic acrylamide-based polymer and an ATC; and bentonite in combination with a substantially non-ionic acrylamide-based polymer. Suitable retention systems comprising aluminium compounds include those comprising cationic polymers and anionic inorganic particles, preferably anionic silica-based particles.

The components of the retention system may also be selected from organic polymers and organic polymers in combination with aluminium compounds, e.g. main polymers; a main polymer in combination with an LMW polymer, and a main polymer in combination with an aluminium compound, as described hereinabove. In a first aspect of this embodiment, the retention system contains two oppositely charged polymers, i.e. anionic polymer+cationic polymer, e.g. an anionic polymer in combination with a cationic main polymer, and an anionic polymer in combination with a cationic ATC polymer. In a second aspect of this embodiment, the retention system contains two amphoteric and/or cationic polymers, e.g. two cationic main polymers, and a cationic main polymer in combination with an LMW cationic polymer. In another embodiment, the retention system comprises two non-ionic polymers, preferably non-ionic polymers capable of interaction through hydrogen bonding, e.g. alkyleneoxide-based polymers like polyethyleneoxide and phenolic resins.

In the process of the invention, the retention component (s) are introduced into the HC flow which is to be mixed with the LC flow in the headbox, thereby introducing the component(s) into the resulting aqueous flow in the dilution process. The components of retention systems can be added to the stock flow in conventional manner in any order. When using a retention system comprising anionic inorganic particles and a main polymer, e.g. a cationic polymer, it is preferred to add the polymer to the HC stock flow before the microparticulate material, even if the opposite order of addition may be used. It is further preferred to add the first component, e.g. the main polymer, before a shear stage, which can be selected from pumping, mixing, cleaning, etc., and to add to the second component, e.g. the microparticles, after that shear stage. When using an ATC or an aluminium compound, these components are preferably introduced into the HC stock flow prior to or simultaneous with other components of the retention system, for example in order to neutralize anionic trash substances. It is also possible to introduce a part of one ore more retention components into the LC flow in case the components do not adversely affect the performance of the additional additive introduced into the LC flow, as described hereinafter. This mode of split addition may be applied with components which can be adversely affected by high levels of shear. By addition of a part of such a component to the LC flow, the component and the flocs formed may be subjected to less severe shear conditions, thereby improving the effects for the purpose of this invention. Examples of such components include anionic inorganic particles. Generally, when using split addition to both the HC flow and the LC flow, the predominant amount of the component is preferably added to the HC flow. The retention component(s) added to the HC flow preferably have higher retention performance than the retention component(s) added to the LC flow.

The components of the retention system are introduced into the stock to be dewatered in amounts which can vary within wide limits depending, on inter alia, type and number of components, type of stock, type of filler, filler content, point of addition, flow of addition, etc. Generally the components are added in amounts that give better retention than is obtained when not adding the components. When using anionic inorganic particles as a microparticulate material, the total amount added is usually at least 0.001% by weight, often at least 0.005% by weight, based on dry substance of the stock. The upper limit is usually 1.0% and suitably 0.6% by weight. When using anionic silica-based particles, the total amount is suitably within the range of from 0.005 to 0.5% by weight, calculated as $SiO_2$ and based on dry stock substance, preferably within the range of from 0.01 to 0.2% by weight. Organic polymers, e.g. main polymers, are usually added in total amounts of at least 0.001%, often at least 0.005% by weight, based on dry stock substance. The upper limit is usually 3% and suitably 1.5% by weight. When using an LMW cationic organic polymer in the process, it can be added in an amount of at least 0.05%, based on dry substance of the stock to be dewatered. Suitably, the amount is in the range of from 0.07% to 0.5%, preferably in the range from 0.1 to 0.35%. When using an aluminium compound in the process, the total amount introduced into the stock to be dewatered is dependent on the type of aluminium compound used and on other effects desired from it. It is for instance well-known in the art to utilize aluminium compounds as precipitants for rosin-based sizing agents. The total amount added is usually at least 0.05%, calculated as $Al_2O_3$ and based on dry stock substance. Suitably the amount is in the range of from 0.8 to 2.8%, preferably in the range from 0.1 to 2.0%.

According to the invention, an additional additive is introduced into the LC flow, hereafter referred to as an LC flow additive. Preferably this additive is such that it gives slower dewatering than is obtained when not adding it. Preferably the LC flow additives is a water-soluable or water-dispersable organic or inorganic polymer which can be derived from natural or synthetic sources. The LC flow additive is suitably selected from non-ionic and anionic organic polymers, which can be linear, branched or cross-linked. Examples of suitable LC flow additives include non-ionic and anionic polymers based on acrylamide and carbohydrates, polysaccharides, gums and alginates; including native and chemically modified starches, such as those based on potato, wheat, corn, tapioca, barley, oat, and rice, guar gum, xanthan gum, gum arabicum, locust bean gum, cellulose derivatives, such as carboxy methylcellulose, etc. For acrylamide-based polymers the molecular weight should suitably be above 1,000,000, preferably above 5,000,000 and most preferably above 10,000,000. Usually the molecular weight is below about 40,000,000. The acrylamide-based polymers can have a degree of anionic substitution up to 0.3, suitably up to 0.2 and preferably up to 0.1. For carbohydrates the molecular weight should suitably be above 200,000, preferably above 300,000 and most preferably above 500,000. The carboohydrates are preferably non-ionic or slightly anionic in nature, and they can have a degree of anionic substitution up to 0.15. The LC flow additive is suitably added in an amount which is sufficient to give slower dewatering of the stock, usually at least 0.01 ppm based on the mass of aqueous LC flow, it can be added in an amount of from 0.01 to 50 ppm, based on the mass of aqueous LC flow, suitably from 0.05 to 40 ppm and preferably from 0.1 to 20 ppm.

The amounts and the points of addition of the components of the retention system and/or the LC flow additive of the present invention can be selected and adjusted so as to achieve optimum ash content cross profile and formation of the paper web formed, as will be easily appreciated by a person skilled in the art. In a preferred embodiment of the invention, on-line measurement devices, such as, for example, Accuray, Measurex, Roibox and the like, are used for on-line basis weight cross profile, filler content cross profile and moisture measurements. By analyzing the information obtained from such measurements in combination with information about additions, for example by means of a computer system, the amounts and points of addition of the retention component(s) and/or the LC flow additive, as described hereinbefore, can be adjusted in order to control and optimize the basis weight and filler content cross profiles.

The process according to the invention is used for the production of paper. The term "paper", as used herein, of course include not only paper and the production thereof, but also other web-like products, such as for example board and paperboard, and the production thereof. The process can be used in the production of paper from different types of suspensions of cellulose containing fibres, and the suspensions should suitably contain at least 25% and preferably at least 50% by weight of such fibres, based on dry substance. The suspensions can be based on fibres from chemical pulp, such as sulphate and sulphite pulp, thermomechanical pulp, chemo-thermomechanical pulp, organosolv pulp, refiner pulp or groundwood pulp from both hardwood and softwood, or fibres derived from one year plants like elephant grass, bagasse, flax, straw, etc., and can also be used for suspensions based on recycled fibres. The suspension also contain mineral fillers of conventional types, such as, for example, kaolin, clay, titanium dioxide, gypsum, talc and both natural and synthetic calcium carbonates, such as, for example, chalk, ground marble, ground calcium carbonate, and precipitated calcium carbonate. The stock can of course also contain papermaking additives of conventional types, such as wet-strength agents, stock sizes, such as those based on rosin, ketene dimers or alkenyl succinic anhydrides, etc.

Suitably the invention is applied on paper machines producing wood-containing paper and paper based on recycled fibres, such as SC, LWC and different types of book and newsprint papers, and on machines producing wood-free printing and writing papers, the term wood-free meaning less than about 15% of wood-containing fibres. The invention is also applicable for the production of board on single layer machines as well as on machines producing paper or board in multilayered headboxes, and on machines with several headboxes, in which one or more of the layers essentially consist of recycled fibres. In machines using multi layer headboxes, or several headboxes, in which one or more of the layers are produced with a headbox of the dilution type, the invention can be applied to one or more of these layers. Suitably the invention is applied on paper machines running at a speed of from 600 to 2500 m/min and preferably from 1000 to 2000 m/min.

The invention is further illustrated in the following Example which, however, is not intended to limit the same. Parts and % relate to parts by weight and % by weight, respectively, unless otherwise stated.

EXAMPLE

The process of this invention was evaluated on a paper machine having a dilution headbox producing neutral paper at a speed of 1200 m/min using an SC paper furnish containing about 30% of clay. Trials were made by introduction of a microparticle retention system into the main stock flow (HC flow) with and without introduction of an LC flow additive to white water (LC flow) obtained by dewatering the stock in the wire section. The white water was recycled and injected into the headbox at a plurality of points across its width. In order to achieve a dried paper web with an essentially uniform basis weight cross profile, the volume ratio of HC flow to LC flow was adjusted across the width of the headbox from about 80:20 in the lateral areas to about 95:5 in the centre. The formation and ash content profile of the paper produced was analyzed by measuring these parameters in the lateral and mid areas of the web.

The components of the microparticle retention system consisted of and LMW cationic polyamine with a molecular weight of about 200,000, a cationic acrylamide-based polymer with a molecular weight of about 5 million, and a sol of aluminium-modified silica of the type disclosed in U.S. Pat. No. 5,368,833 which had an S-value of about 25% and contained silica particles with a specific surface area of about 900 $m^2/g$ which surface-modified with aluminium to a degree of 5%. The components were introduced into the HC flow in the said order, i.e. the LMW polymer was added upstream in an amount of 0.5 kg/tonne, based on dry stock, followed by downstream addition of the main polymer in an amount of 0.75 kg/tonne, and then further downstream addition of the silica sol in an amount of 1.0 kg/tonne, calculated as $SiO_2$ and based on dry stock. The LC flow additive was a non-ionic acrylamide-based polymer with a molecular weight of about 20 million, which when used was added in an amount of 0.75 kg/tonne, based on dry stock.

When adding the components of the retention system to the HC flow but not adding the LC flow additive, the ash content was 29.5% in the centre of the web and 30.5% in the lateral areas, i.e. about 3.4% higher in the centre than in the lateral areas. However, when using both the retention system and the LC flow additive, the ash content cross profile was only about 0.7% higher in the centre of the web. Accordingly, when there was no LC flow additive used the deviation in the ash content was five times larger than when the LC flow additive was employed. The introduction of the LC flow additive further resulted in slower dewatering on the wire and the paper web produced had a more uniform formation profile across its width; the formation deviation was less (0.05 units compared to 0.10 units) and the average level was better (0.46 units compared to 0.568 units), measured as normalised formation, i.e. standard deviation of the basis weight divided by the basis weight.

What is claimed is:

1. A process for the production of paper on a paper machine containing a dilution headbox which comprises (a) introducing one or more retention components into a main aqueous flow containing cellulosic fibres and filler, and feeding the main aqueous flow into the head box, (b) introducing and additive into a diluting aqueous flow and feeding the diluting aqueous flow into the headbox, the additive being selected from non-ionic or anionic organic polymers, and the additive being added in an amount effective to decrease the rate of dewatering over the rate of dewatering in the absence of the additive, and (c) mixing the main aqueous flow with the diluting aqueous flow in the headbox to form a resulting aqueous flow which is ejected onto a wire and dewatered to form a web of paper.

2. The process of claim 1, wherein the main aqueous flow has a greater volume and a higher consistency than the diluting aqueous flow.

3. The process of claim 1, wherein the diluting aqueous flow is white water obtained by dewatering the resulting aqueous flow.

4. The process of claim 1, wherein the retention components are selected from the group consisting of microparticle retention systems and retention systems comprising at least two organic polymers.

5. The process of claim 4, wherein the retention components comprise at least one amphoteric and/or cationic polymer and anionic silica-based particles.

6. The process of claim 5, wherein the anionic silica-based particles are selected from the group consisting of colloidal silica, polysilicic acid, colloidal aluminium-modified silica and aluminium silicate.

7. The process of claim 5, wherein the cationic polymer is cationic starch or cationic acrylamide-based polymer having a molecular weight of at least about 1,000,000.

8. The process of claim 1, wherein the retention components comprise a cationic polymer which is cationic starch or cationic acrylamide-based polymer having a molecular weight of at least about 1,000,000 and a low molecular weight cationic polymer with a molecular weight up to about 500,000.

9. The process of claim 1, wherein the retention components comprise a cationic acrylamide-based polymer and bentonite.

10. The process of claim 5, wherein the retention components further comprise an aluminium compound.

11. The process of claim 1, wherein the additive introduced into the diluting aqueous flow is selected from non-ionic or anionic acrylamide-based polymer or non-ionic or anionic polysaccharides.

12. The process of claim 11, wherein the additive is a non-ionic acrylamide-based polymer.

13. A process for the production of paper on a paper machine containing a dilution headbox which comprises (a) providing a main aqueous flow containing cellulosic fibres and filler, (b) introducing one or more retention components into said main aqueous flow in an amount sufficient to give better retention than is obtained when not introducing said one or more retention components, (c) providing a diluting aqueous flow, (d) introducing an additive effective in affecting dewatering rate into said diluting aqueous flow, (e) diluting the obtained main aqueous flow with the obtained diluting aqueous flow in said diluting headbox to form a resulting aqueous flow, and (f) ejecting said resulting aqueous flow onto a wire and dewatering said resulting aqueous flow to form a web of paper, wherein said additive effective in affecting dewatering rate is introduced in an amount sufficient to give slower dewatering of said resulting aqueous flow than is obtained when not introducing said additive.

14. The process of claim 13, wherein the retention components comprise two or more components which, when used in combination, give better retention than is obtained when not adding the components.

15. The process of claim 13, wherein the retention components are selected from the group consisting of organic polymers, organic polymers in combination with aluminium compounds, and organic polymers in combination with inorganic microparticles.

16. The process of claim 13, wherein the additive introduced into the diluting aqueous flow is an organic or inorganic polymer.

17. The process of claim 13, wherein the diluting aqueous flow is white water obtained by dewatering the resulting aqueous flow.

18. The process of claim 13, wherein the paper machine produces paper at a speed of from 1000 to 2000 m/min.

19. A process for the production of paper on a paper machine containing a dilution headbox which comprises (a) introducing one or more retention components into a main aqueous flow containing cellulosic fibers and filler, and feeding the main aqueous flow into the headbox, (b) introducing an additive into a diluting aqueous flow containing filler and feeding the diluting aqueous flow into the headbox, the additive being selected from non-ionic or anionic organic polymers, and the additive being added in an amount effective to obtain a more uniform ash content cross profile than the ash content cross profile in the absence of the additive, and (c) mixing the main aqueous flow with the diluting aqueous flow in the headbox to form a resulting aqueous flow which is ejected onto a wire and dewatered to form a web of paper.

20. The process of claim 19, wherein the main aqueous flow has a greater volume and a higher consistency than the diluting aqueous flow.

21. The process of claim 19, wherein the diluting aqueous flow is white water obtained by dewatering the resulting aqueous flow.

22. The process of claim 19, wherein the retention components are selected from the group consisting of microparticle retention systems and retention systems comprising at least two organic polymers.

23. The process of claim 22, wherein the retention components comprise at least one amphoteric and/or cationic polymer and anionic silica-based particles.

24. The process of claim 19, wherein the additive introduced into the diluting aqueous flow is selected from non-ionic or anionic acrylamide-based polymers or non-anionic or anionic polysaccharides.

* * * * *

UNITED STATES PATENT AND TRADEMARK OFFICE

CERTIFICATE OF CORRECTION

PATENT NO. : 6,113,741

DATED : September 5, 2000

INVENTOR(S) : K. KETTUNEN, et al.

It is certified that error appears in the above-indentified patent and that said Letters Patent is hereby corrected as shown below:

In column 10, line 11, change "and" to --an--.

In column 12, line 31, change "non-anionic" to --non-ionic--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*